US006189155B1

(12) United States Patent
Boulanger

(10) Patent No.: US 6,189,155 B1
(45) Date of Patent: Feb. 20, 2001

(54) CLOSE-FITTING UNDERGARMENT FOR WOMEN

(76) Inventor: Lyne L. Boulanger, 2949 Myrtle Oak Cir., Davie, FL (US) 33328

( * ) Notice: Under 35 U.S.C. 154(b), the term of this patent shall be extended for 0 days.

(21) Appl. No.: 09/569,450

(22) Filed: May 12, 2000

(51) Int. Cl.[7] ..... A41B 9/04
(52) U.S. Cl. ..... 2/409; 2/69
(58) Field of Search ..... 2/409, 239, 69; 66/177, 176, 195, 196, 178 R

(56) References Cited

U.S. PATENT DOCUMENTS 3,487,473 * 1/1970 Janhsen ..... 2/409
4,267,607 * 5/1981 Tino ..... 2/409
4,903,345 * 2/1990 Oakley ..... 2/240
4,920,769 * 5/1990 Rickerl ..... 66/176
5,023,957 * 6/1991 Harvey ..... 2/409

* cited by examiner

*Primary Examiner*—Gloria M. Hale

(57) ABSTRACT

A close-fitting undergarment for improving the user's appearance and comfort. The close-fitting undergarment includes a hosiery item having a thong-style top which is adapted to cover a user's waist, and also having leg portions which is attached to the top and which is adapted to cover the user's legs.

10 Claims, 3 Drawing Sheets

CLOSE-FITTING UNDERGARMENT FOR WOMEN

BACKGROUND OF THE INVENTION

1. Field of the Invention

The present invention relates to a thong-style hose and more particularly pertains to a new close-fitting undergarment for improving the user's appearance and comfort.

2. Description of the Prior Art

The use of a thong-style hose is known in the prior art. More specifically, a thong-style hose heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,914,799; U.S. Pat. No. 5,023,957; U.S. Pat. No. 3,449,932; U.S. Pat. No. 4,862,523; U.S. Pat. No. 4,282,609; and U.S. Pat. No. Des. 243,561.

While these devices fulfill their respective, particular objectives and requirements, the aforementioned patents do not disclose a new close-fitting undergarment. The inventive device includes a hosiery item having a thong-style top which is adapted to cover a user's waist, and also having leg portions which is attached to the top and which is adapted to cover the user's legs.

In these respects, the close-fitting undergarment according to the present invention substantially departs from the conventional concepts and designs of the prior art, and in so doing provides an apparatus primarily developed for the purpose of improving the user's appearance and comfort.

SUMMARY OF THE INVENTION

In view of the foregoing disadvantages inherent in the known types of thong-style hose now present in the prior art, the present invention provides a new close-fitting undergarment construction wherein the same can be utilized for improving the user's appearance and comfort.

The general purpose of the present invention, which will be described subsequently in greater detail, is to provide a new close-fitting undergarment which has many of the advantages of the thong-style hose mentioned heretofore and many novel features that result in a new close-fitting undergarment which is not anticipated, rendered obvious, suggested, or even implied by any of the prior art thong-style hose, either alone or in any combination thereof.

To attain this, the present invention generally comprises a hosiery item having a thong-style top which is adapted to cover a user's waist, and also having leg portions which is attached to the top and which is adapted to cover the user's legs.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new close-fitting undergarment which has many of the advantages of the thong-style hose mentioned heretofore and many novel features that result in a new close-fitting undergarment which is not anticipated, rendered obvious, suggested, or even implied by any of the prior art thong-style hose, either alone or in any combination thereof.

It is another object of the present invention to provide a new close-fitting undergarment which may be easily and efficiently manufactured and marketed.

It is a further object of the present invention to provide a new close-fitting undergarment which is of a durable and reliable construction.

An even further object of the present invention is to provide a new close-fitting undergarment which is susceptible of a low cost of manufacture with regard to both materials and labor, and which accordingly is then susceptible of low prices of sale to the consuming public, thereby making such close-fitting undergarment economically available to the buying public.

Still yet another object of the present invention is to provide a new close-fitting undergarment which provides in the apparatuses and methods of the prior art some of the advantages thereof, while simultaneously overcoming some of the disadvantages normally associated therewith.

Still another object of the present invention is to provide a new close-fitting undergarment for improving the user's appearance and comfort.

Yet another object of the present invention is to provide a new close-fitting undergarment which includes a hosiery item having a thong-style top which is adapted to cover a user's waist, and also having leg portions which is attached to the top and which is adapted to cover the user's legs.

Still yet another object of the present invention is to provide a new close-fitting undergarment that gives the user a more natural appearance.

Even still another object of the present invention is to provide a new close-fitting undergarment that would not flatten the user's buttock but would instead enhance it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
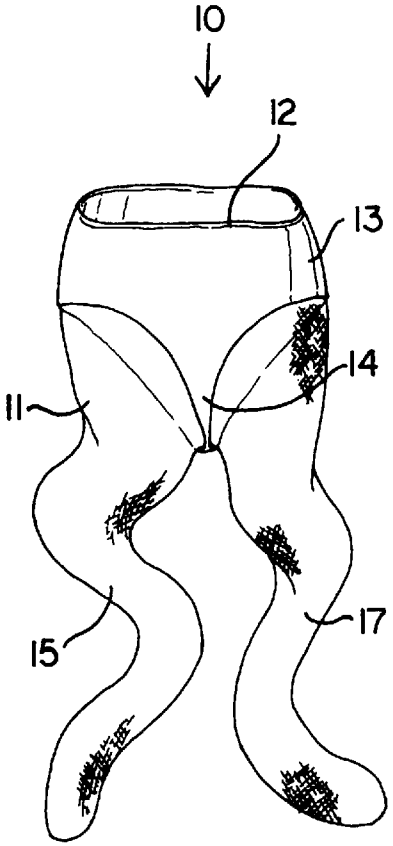
FIG. 3 is a rear perspective view of the present invention.
Figure 2:
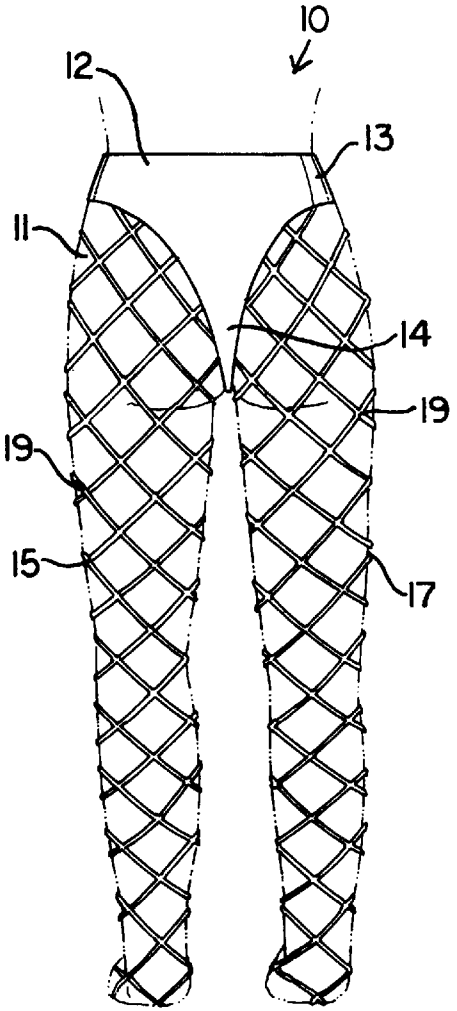
FIG. 2 is a rear perspective view of the fourth embodiment of the present invention shown in use.
Figure 1:
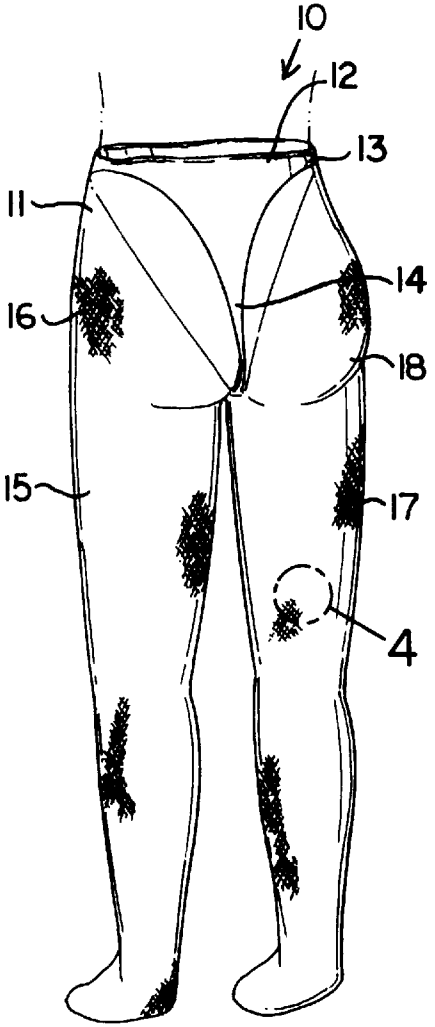
FIG. 1 is a rear perspective view of a new close-fitting undergarment according to the present invention shown in use.
Figure 4B:
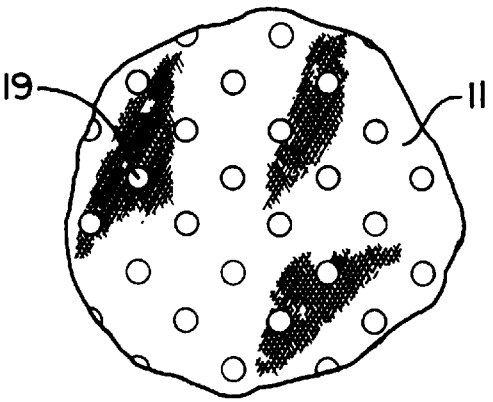
FIG. 4B is a detailed view of a design and pattern of the fourth embodiment of the present invention.
Figure 4A:
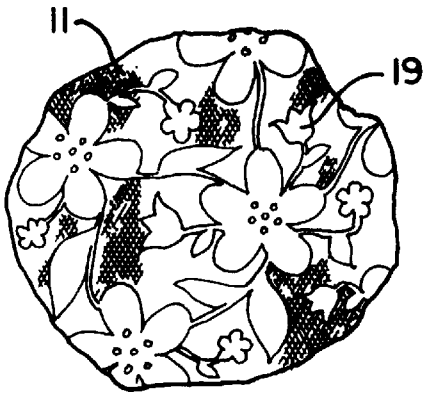
FIG. 4A is a detailed view of a design and pattern of the fourth embodiment of the present invention.
Figure 4C:
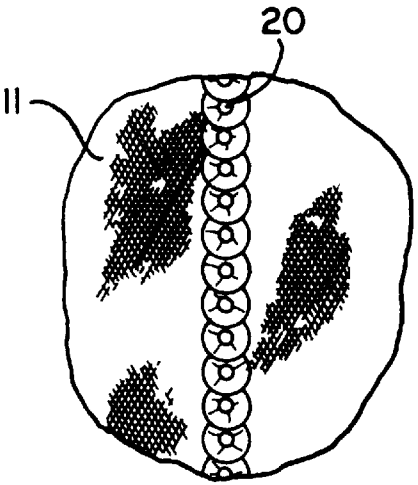
FIG. 4C is a detailed view of a seam of the third embodiment of the present invention.
Figure 6:
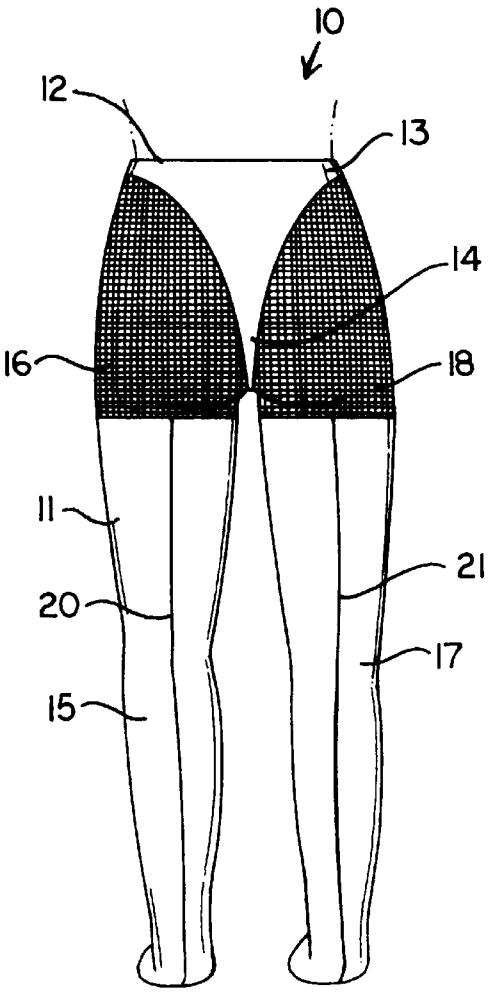
FIG. 6 is a rear perspective view of another second embodiment of the present invention.
Figure 5:
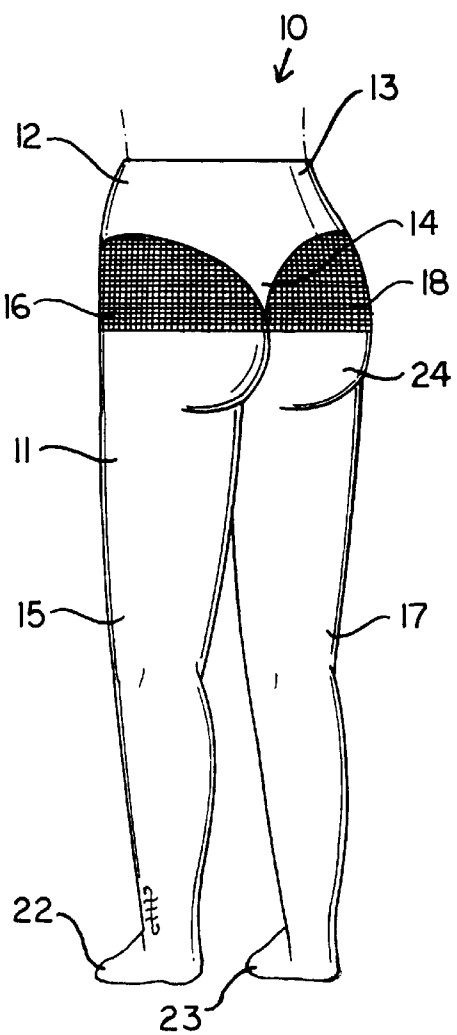
FIG. 5 is a rear perspective view of the second and fifth embodiments of the present invention.

With reference now to the drawings, and in particular to FIGS. 1 through 6 thereof, a new close-fitting undergarment embodying the principles and concepts of the present invention and generally designated by the reference numeral 10 will be described.

As best illustrated in FIGS. 1 through 6, the close-fitting undergarment 10 generally comprises a hosiery item 11 having a top 12 which is adapted to cover a user's waist, and also having leg portions 15, 17 which are securely attached and sewn to the top 12 and which are adapted to cover the user's legs. The top 12 of the hosiery item 11 is essentially a thong having a first strap 13 adapted to fit about the user's waist and also having a second strap 14 adapted to extend about the user's crotch and being securely and integrally connected to the first strap 13. The leg portions 15, 17 are securely attached and sewn along and to the first and second straps 13, 14 of the thong 12.

As a second embodiment, each of the leg portions 15, 17 includes an upper portion 16, 18 which is adapted to fit about a person's buttock 24 with the upper portion 16, 18 being made of denser fabric than the rest of the leg portion 15, 17 to provide support for the user.

As a third embodiment, each of the leg portions 15, 17 includes a back portion which extends from the thong 12 to a bottom of the leg portion 15, 17 with the back portion having a seam 20, 21 extending along the length thereof.

As a fourth embodiment, the leg portions 15, 17 include a plurality of patterns and designs 19 conventionally arranged therealong and thereabout.

As a fifth embodiment, the leg portions include toe portions which are essentially reinforced with dense fabric to prevent holes from being easily made in the toe portions.

In use, the user wears the hosiery item 11 just like a conventional panty hose except that instead of the top being a panty-style, it is a thong 12 which provides more comfort than the conventional panty hose and a more appealing appearance for the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A close-fitting undergarment for women comprising:

a hosiery item having a top which is adapted to cover a user's waist, and also having leg portions which is attached to said top and which is adapted to cover the user's legs; and wherein said top comprises a thong having a first strap adapted to fit about the user's waist and also having a second strap adapted to extend about the user's crotch and being securely connected to said first strap.

2. A close-fitting undergarment for women as described in claim 1, wherein said leg portions are securely attached to said first and second straps of said thong.

3. A close-fitting undergarment for women as described in claim 1, wherein each of said leg portions includes an upper portion which is adapted to fit about a person's buttock, said upper portion being made of denser fabric than the rest of said leg portion to provide support for the user.

4. A close-fitting undergarment for women as described in claim 1, wherein each of said leg portions includes a back portion which extends from said thong to a bottom of said leg portion, said back portion having a seam extending along the length thereof.

5. A close-fitting undergarment for women as described in claim 1, wherein said leg portions include a plurality of designs thereon.

6. A close-fitting undergarment for women comprising:

a hosiery item having a top which is adapted to cover a user's waist, and also having leg portions which is attached to said top and which is adapted to cover the user's legs, said top being essentially a thong having a first strap adapted to fit about the user's waist and also having a second strap adapted to extend about the user's crotch and being securely connected to said first strap, said leg portions being securely attached along and to said first and second straps of said thong.

7. A close-fitting undergarment for women as described in claim 6, wherein each of said leg portions includes an upper portion which is adapted to fit about a person's buttock, said upper portion being made of denser fabric than the rest of said leg portion to provide support for the user.

8. A close-fitting undergarment for women as described in claim 6, therein each of said leg portions include a back portion which extends from said thong to a bottom of said leg portion, said back portion having a seam extending along the length thereof.

9. A close-fitting undergarment for women as described in claim 6, wherein said leg portions include a plurality of patterns and designs arranged therealong and thereabout.

10. A close-fitting undergarment for women as described in claim 6, wherein said leg portions include toe portions which are essentially made of dense fabric to prevent holes from being easily made therein.

* * * * *